US005954893A

United States Patent [19]

Baldwin et al.

[11] Patent Number: 5,954,893

[45] Date of Patent: Sep. 21, 1999

[54] TREATMENT OF ALUMINIUM OR ALUMINIUM ALLOYS

[75] Inventors: Kevin R Baldwin; Christopher J E Smith; Peter L Lane, all of Farnborough, United Kingdom

[73] Assignee: The Secretary of State for Defence, United Kingdom

[21] Appl. No.: 08/836,607

[22] PCT Filed: Nov. 13, 1995

[86] PCT No.: PCT/GB95/02655

§ 371 Date: May 22, 1997

§ 102(e) Date: May 22, 1997

[87] PCT Pub. No.: WO96/15296

PCT Pub. Date: May 23, 1996

[30] Foreign Application Priority Data

Nov. 14, 1994 [GB] United Kingdom ..... 9422952

[51] Int. Cl.[6] ..... C23C 22/82

[52] U.S. Cl. ..... 148/272; 148/247; 148/256; 148/273; 148/275; 427/216; 428/658

[58] Field of Search ..... 148/247, 272, 148/273, 256, 275; 427/216; 428/658

[56] References Cited

U.S. PATENT DOCUMENTS 2,018,388 10/1935 Tosterud .

4,264,378 4/1981 Oppen et al. .

4,828,615 5/1989 Cape .

4,992,115 2/1991 Ikeda ..... 148/247

5,362,335 11/1994 Rungta ..... 148/272

FOREIGN PATENT DOCUMENTS

A57-192 290 11/1982 Japan .

*Primary Examiner*—John Sheehan
*Assistant Examiner*—Andrew L. Oltmans
*Attorney, Agent, or Firm*—Nixon & Vanderhye

[57] ABSTRACT

A method for treating the surface or surfaces of an aluminium or aluminium alloy containing substrate to confer corrosion resistance in which a porous layer is created on the surface or surfaces and then the surface or surfaces are treated with a solution or gel comprising a metavanadate ion, and further treated with a solution comprising a metal ion selected to coprecipitate with the metavanadate ion to form a sparingly soluble compound within the pores of the porous layer. A corrosion resistant coating for aluminium or aluminium alloy comprising a porous surface layer containing within the pores a deposit of a sparingly soluble metal metavanadate. The porous layer may be an oxide layer produced for example by acid anodising.

21 Claims, No Drawings

TREATMENT OF ALUMINIUM OR ALUMINIUM ALLOYS

The present invention relates to the protection of surfaces and more particularly relates to the protection of surfaces with corrosion inhibitors.

Airframes and weapons systems need to be protected against corrosion. A conventional technique is to anodise the surface of aluminium or aluminium alloy. This provides some protection as a barrier layer also promotes good paint adhesion. To get adequate levels of corrosion resistance, chromic acid anodising is frequently used, which imparts a degree of corrosion resistance to the base metal, partly due to the presence of inhibiting chromate species in the anodised film. A paint scheme often used is an epoxy primer pigmented with a chromate salt corrosion inhibitor followed by a polyurethane top coat. When the paint scheme becomes damaged the chromate salt leaches out from the primer and inhibits the corrosion of the exposed metal. The main drawback of the chromic acid anodising process is that the chemicals used are toxic and the process is potentially harmful to the environment. Thus the process is effective but has environmental disadvantages and alternative non-environmentally harmful techniques are desirable.

It has been previously suggested to use other acids in the anodising process. such as sulphuric acid, as replacements for chromic acid. Such a technique could offer a lower toxicity and generally less expensive alternative to chromic acid anodising, but sulphuric acid films do not contain an inherent, corrosion inhibiting component and the treatment can have a harmful effect on fatigue performance of the metals. The present invention relates to improved corrosion inhibiting systems which overcome or alleviate one or more of the drawbacks of previous systems.

Thus according to the present invention there is provided a method for treating the surface or surfaces of an aluminium or aluminium alloy containing substrate comprising the steps of (a) creating a porous layer on the surface or surfaces of the aluminium or aluminium alloy, (b) treating the surface or surfaces with a solution or gel comprising a metavanadate ion, (c) preferably washing the surface or surfaces to remove excess metavanadate ion and (d) treating the surface or surfaces with a solution comprising a metal ion selected to coprecipitate with the metavanadate ion to form a sparingly soluble compound within the pores of the oxide layer.

The metal ion is preferably selected from cerium, nickel, zinc, strontium, barium, lanthanum and calcium; more preferably from cerium (III), nickel (II) and zinc(II). These offer corrosion inhibition from non-carcinogenic species, so that the protective treatment provides an effective and lower toxicity alternative to chromate anodising. The solution comprising a metal ion is conveniently the sulphate and the metavanadate solution or gel conveniently comprises sodium metavanadate. These two solutions effect ready precipitation, by a simple double decomposition reaction, of the desired sparingly soluble metavanadate species into the pores of the anodic film.

In practice, the porous layer will usually be an oxide layer, although it will be understood that the precise chemistry of the layer is not of importance to the working of the invention. The exact process by which the porous oxide layer is produced is not critical to the invention, and various methods will suggest themselves to those skilled in the art. However, a convenient technique will utilise a porous film anodising process step, suitably the step of anodising the aluminium or aluminium alloy by treating the surface or surfaces with a solution comprising a suitable acid.

Particularly preferred acids are for example sulphuric, phosphoric, or oxalic acid, which produce a porous film oxide layer without the toxicity associated with chromic acid anodising, although any acid which produced a suitably porous film (including chromic) could be used at this stage. These acid anodising treatments will be known to those skilled in the art of protection of aluriniurn, and it will be understood that it will involve suitable surface preparation, the step of applying the acid, and a neutralisation and washing step. This stage produces a porous anodic film without an inherent corrosion resisting component, and has been used, for example, as a pretreatment prior to painting of aluminium aerospace alloys. The remainder of the process provides a novel and simple technique for incorporating an inhibitive species into the anodic film.

While not wishing to be bound by any theory, it is believed that the treatment of the anodised film with a solution or gel comprising a metavanadate ion allows the inhibiting species to enter the pores of the anodic film. This results in the film having "built in" inhibitors which can leach out over a long period of time and allows the self repair of the film if it becomes damaged. The effectiveness and durability of the metavanadate treated anodic films is further increased by sealing for example in hot water or aqueous solution.

The metal ion used in step (d) is chosen to coprecipitate with the metavanadate ion to form a sparingly soluble compound or "built in" inhibitor. The inhibitor is desirably sufficiently soluble to give an effective inhibitor concentration but not so soluble as to allow rapid leaching out of the inhibitor which would give an insufficient corrosion protected time. Also the metal ion is desirably non aggressive to aluminium or aluminium alloys.

The metal ion is preferably selected from cerium, nickel, zinc, strontium, barium, lanthanum and calcium; more preferably from cerium (III), nickel (II) and zinc(II). These offer corrosion inhibition from non-carcinogenic species, so that the protective treatment provides an effective and lower toxicity alternative to chromate anodising. The solution comprising a metal ion is conveniently the sulphate and the metavanadate solution or gel conveniently comprises sodium metavanadate. These two solutions effect ready precipitation, by a simple double decomposition reaction. of the desired sparingly soluble metavanadate species into the pores of the anodic film.

The method of the present invention is preferably carried out at a solution pH of from 5 to 7.5; a lower pH may cause corrosion of the aluminium or aluminium alloys and a higher more alkaline pH could result in dissolution of the aluminium oxide surface layer to form aluminates.

The order of steps (b) and (d) is not essential and may for example be reversed. In either case the method preferably further comprises the step of washing the anodised surface or surfaces between application of the metavanadate and application of the metal ion to remove excess of the first applied solution.

The structure of metavanadates and their ortho- and para-counterparts is discussed in the book "Chernistry of the Elements" by N. N. Greenwood and A. Earnshaw (at page 146) published by Pergamon Press in 1984.

It is envisaged that the process may be carried out on a preexisting aluminium or aluminium alloy structure in situ.

A significant increase in the level of corrosion resistance of the treated aluminium alloy panels is obtained if the resultant metavanadate treated anodic layers are subjected to a sealing process. The layers are preferably hot sealed by immersion in a hot aqueous solution maintained at or near boiling point, for example at 96 to 100° C. Sealing may be by immersion in hot distilled water. Also the hot sealing can be carried out in solutions of the metavanadate ion or in solutions of a metal cation selected from the group listed, which may be but is not necessarily the same as the cation selected for use in precipitating the vanadate salt. A particularly effective seal is obtained by immersion in a hot solution comprising cerium (III) cations.

In a further aspect, the invention provides a corrosion resistant coating for aluminium or aluminium alloy comprising a porous layer, conveniently an anodised layer, on the surface or surfaces thereof containing within the pores of the porous layer a deposit of a sparing soluble metal metavanadate.

The metal is preferably selected from cerium, nickel, zinc, strontium, barium, lanthanum and calcium; more preferably cerium (III), nickel (II) and zinc(II). The anodised layer containing the metavanadate deposits is preferably sealed.

The invention will now be described by way of example only.

The metal panels used in the tests were aluminium alloy panels of unclad 2014-T6 (to BS L150) supplied as 1 mm thick aerospace quality sheet. The nominal composition of the alloy (in weight per cent) was 4.2% copper, 0.74% silicon, 0.4% manganese, 0.29% iron, 0.5% magnesium, 0.06% zinc and the remainder being aluminium. The alloy is representative of aluminium copper alloys used in aircraft construction.

The aluminium alloy panels were degreased and cleaned in accordance with Defense Standard 03/2-Cleaning and Preparation of Metal Surfaces. The panels were then anodised by treatment with sulphuric acid according to Defense Standard 03/25 in an electrolytic cell. The sulphuric acid electrolyte was air agitated and had a concentration of 150 g/l. A lead cathode was used and the temperature was 18–22° C. The current densities used were 1–2 amps/dm 2 at 14–25 volts and 1.5 amps/dm 2 at 18–22 volts. The panels were then rinsed in air agitated distilled water and neutralised using 5% $Na_2CO_3$ solution. The anodised film thicknesses were between 8 and 13 $\mu$m as measured by a permnascope.

Subsequent to the anodising of the aluminium alloy panels, they were treated as follows (a) rinsing in distilled water at ambient temperature (18–25° C.), (b) immersion for 10 minutes in an aqueous solution of a metallic cation at 40° C. (c) rinsing in distilled water to remove excess aqueous solution of the metallic cation, (d) immersion for 10 minutes in an aqueous solution of sodium metavanadate of concentration 25 g/at 40° C. and (e) rinsing in distilled water followed by air drying.

The metallic cations used were cerium (III) sulphate hydrate at a concentration of 10 g/l, nickel (II) sulphate at a concentration of 25 g/l and zinc (II) sulphate at a concentration of 25 g/l. The anodic film, immediately after anodising, is porous and highly absorbent. It is believed that by immersing the substrate in consecutive solution it is possible to produce a reaction between the metal cations and the vanadate ions to precipitate sparingly soluble vanadates in the pores of the anodic film thereby creating a reservoir of corrosion inhibitor. The solution concentrations were chosen to ensure that a sufficient concentration of inhibitor was precipitated in the pores of the surface.

It is desirable that the temperature of the water used for the rinsing steps is not too high to avoid leaching out of the inhibitor from the pores of the anodic film. The temperature range used for the solutions was from 10° C. to 50° C., the preferred temperature being about 40° C.

The anodised films were immersed in the solutions of steps (b) and (d) above for a time sufficient to allow substantial absorption into the anodised film and the immersion time is preferably 10 minutes or more.

Similar results are obtained if the process steps (b) and (d) are interchanged.

The resultant treated anodised films were then subjected to a sealing process. The sealing process involved immersion of the treated aluminium alloy panels in hot distilled water (pH 5.5 to 6) at 96 to 100° C. for about 10 minutes to reduce the porosity of the anodic films. This distilled water seal was found to significantly increase the level of corrosion resistance of the sealed treated aluminium alloy panels compared to that found for treated but non-sealed aluminium alloy panels.

It was found that a further increase in corrosion resistance was obtained if the treated aluminium alloy panels were immersed in a solution of cerium (III) sulphate hydrate at a concentration of 10 g/l in distilled water at 96 to 100° C. for 10 minutes. A similar effect is envisaged for a sealing process using a hot metavanadate sealing solution in place of the cerium (III) sulphate hydrate.

In neutral salt fog tests, very high levels of corrosion protection were obtained for aluminium alloys treated with the above double dip procedure compared to untreated aluminium alloys. Table 1 shows results for a neutral salt fog test (ASTM B117) for anodised aluminium alloy 2014-T6 panels with and without the inhibitor and sealing treatments of the above examples. Each treated panel is tested for 336 and 100 hours, both in an undamaged state and after subjecting the surface layer to scratching prior to exposure.

TABLE 1 results for a neutral salt fog test (ASTM B117) for anodised aluminium alloy 2014-T6 panels

| | | Appearance of anodised Al alloy panels | | | |
|---|---|---|---|---|---|
| | | Un-damaged | | Scratched | |
| Post-anodising Treatment | Sealing Treatment | 336 hours | 1000 hrs | 336 hours | 1000 hrs |
| None | None (unsealed) | P1,S1 | P2,S2 | P1,S2,E2 | P2,S3,E2 |
| | Sealed (hot water) | N | S1,P2 | N | S1,E1,P2 |
| | Sealed ($Ce^{3+}$) | N | N | N | N |
| $Ni^{2+} + VO_3^-$ | None (unsealed) | N | S1,P1 | N | P1,E1 |
| | Sealed (hot water) | N | N | N | N |
| | Sealed ($Ce^{3+}$) | N | N | N | N |
| $Zn^{2+} + VO_3^-$ | None (unsealed) | N | P1,S1 | N | P1,E1 |
| | Sealed (hot water) | N | N | N | N |
| | Sealed ($Ce^{3+}$) | N | N | N | N |
| $Ce^{3+} + VO_3^-$ | None (unsealed) | N | P2,S1 | E1,S1 | P2,E2 |
| | Sealed (hot water) | N | P1,S1 | N | N |
| | Sealed ($Ce^{3+}$) | N | N | N | N |

N-no attack
P1, P2-slight and severe pitting respectively
E1, E2-slight and severe edge corrosion respectively
S1, S2, S3-slight (<20%) moderate (20–80%) and severe (>80%) surface staining

We claim:

1. A method for treating the surface or surfaces of an aluminum or aluminum alloy containing substrate, said method comprising the steps of:

(a) creating a porous layer on the surfaces of the aluminum or aluminum alloy;

(b) treating the porous layer surface or surfaces with a solution or gel comprising a metavanadate ion; and (c) separately from step (b), treating the surface of surfaces with a solution comprising a metal ion selected to coprecipitate with the metavanadate ion to form a sparingly soluble compound within the pores of the porous layer.

2. A method according to claim 1 wherein the porous layer is an oxide layer.

3. A method according to claim 2 wherein the porous layer on the surface or surfaces of the aluminum or aluminum alloy is created in step (a) by anodizing the aluminum or aluminum alloy by treating the surface or surfaces with an acid solution.

4. A method according to claim 3 wherein the acid comprises sulfuric, phosphoric or oxalic acid.

5. A method according to claim 1 wherein the metal ion is selected from the group consisting of cerium, nickel , zinc, strontium, barium, lanthanum and calcium.

6. A method according to claim 5 wherein the metal ion is selected from the group consisting of cerium (III), nickel (II) and zinc(II).

7. A method according to claim 1 wherein the solution comprising a metal ion is a sulphate.

8. A method according to claim 1 wherein the metavanadate solution or gel comprises sodium metavanadate.

9. A method according to claim 1 further comprising the step of washing the anodized surface or surfaces between application of the metavanadate and application of the metal ion to remove excess solution.

10. A method according to claim 3 further comprising the step of sealing the resultant metavanadate treated anodic layer.

11. A method according to claim 10 wherein the layer is hot sealed by immersion in a hot aqueous solution.

12. A method according to claim 11 wherein the layer is hot sealed by immersion in a hot aqueous solution maintained at 96 to 100° C.

13. A method according to claim 11 wherein the layer is hot sealed by immersion in hot distilled water.

14. A method according to claim 11 wherein the layer is hot sealed by immersion in a solution comprising metavanadate ions.

15. A method according to claim 11 wherein the layer is hot sealed by immersion in a solution of a metal cation selected from the group consisting of cerium, nickel, zinc, strontium, barium, lanthanum and calcium.

16. A method according to claim 15 wherein the layer is hot sealed by immersion in a solution comprising cerium (III) cations.

17. A method according to claim 1 wherein the pH is maintained at between 5 and 7.5.

18. A method according to claim 1 wherein during the steps of application of the metavanadate and application of the metal ion the solutions are maintained at a temperature of between 10 and 50° C.

19. A method according to claim 18 wherein the solutions are maintained at a temperature of about 40° C.

20. A method according to claim 1 wherein the surface or surfaces are painted following precipitation of the sparingly soluble compound within the pores of the porous layer.

21. A corrosion resistant coating for aluminum alloy comprising a porous layer on the surface or surfaces thereof containing within the pores of the layer a deposit of a sparingly soluble metal metavanadate, the metavanadate having been deposit by a method according to claim 1.

* * * * *